US007278706B2

(12) United States Patent
Dodd et al.

(10) Patent No.: US 7,278,706 B2
(45) Date of Patent: Oct. 9, 2007

(54) FLUID EJECTION DEVICE

(75) Inventors: Simon Dodd, Corvallis, OR (US); Sean P. McClelland, Corvallis, OR (US); Lonnie D. Byers, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 344 days.

(21) Appl. No.: 10/696,847

(22) Filed: Oct. 30, 2003

(65) Prior Publication Data

US 2005/0093925 A1 May 5, 2005

(51) Int. Cl.
*B41J 2/135* (2006.01)
*B41J 2/05* (2006.01)

(52) U.S. Cl. ..... 347/44; 347/59

(58) Field of Classification Search ..... 347/44, 347/48, 54, 59, 63
See application file for complete search history.

(56) References Cited

U.S. PATENT DOCUMENTS 4,695,853 A 9/1987 Hackleman et al.
5,010,355 A 4/1991 Hawkins et al.
5,159,353 A 10/1992 Fasen et al.
5,635,968 A 6/1997 Bhaskar et al.
5,757,394 A 5/1998 Gibson et al.
5,774,147 A * 6/1998 Saito et al. ..... 347/59
5,867,200 A 2/1999 Tajima et al.
6,102,528 A 8/2000 Burke et al.
6,309,053 B1 10/2001 Torgerson et al.
6,439,703 B1 8/2002 Anagnostopoulos et al.
6,504,226 B1 1/2003 Bryant
6,543,883 B1 * 4/2003 Dodd et al. ..... 347/58
6,582,063 B1 * 6/2003 Chavarria et al. ..... 347/59

* cited by examiner

*Primary Examiner*—An H. Do

(57) ABSTRACT

A fluid ejection device includes a first heater element and a second heater element spaced a first distance from the first heater element. A first drive transistor is associated with the first heater element and a second drive transistor is associated with the second firing heater element. The second drive transistor is spaced a second distance from the first drive transistor. The second distance is different from the first distance.

35 Claims, 3 Drawing Sheets

FLUID EJECTION DEVICE

BACKGROUND

A fluid ejection device, such as an ink jet printhead, may comprise a substantially linear column of firing chambers with firing resistors. The firing resistors typically have associated drive circuits with drive transistors which energize the resistors to expel fluid from the chamber through an orifice or nozzle. The drive transistors are arranged in a column along side of and substantially parallel with the column of firing resistors. Although a vertical column of resistors is substantially linear, some resistors may be offset horizontally as disclosed, for example, in U.S. Pat. No. 5,635,968.

The fabrication of a fluid ejection device may include a surface etch using an etchant such as TMAH. The etch takes place after the transistors have been fabricated on the substrate. The transistors include contacts which provide an electrical contact to the substrate through vias in an insulation layer. During a subsequent etch, the etchant attacks, i.e. etches away additional portions, of the substrate through openings in the insulation layer through which the contacts pass. The attack often occurs through pinholes located in a passivation layer above the insulation layer in the region of the contacts.

BRIEF DESCRIPTION OF THE DRAWINGS

Features of the invention will readily be appreciated by persons skilled in the art from the following detailed description of exemplary embodiments thereof, as illustrated in the accompanying drawings, in which.

DETAILED DESCRIPTION OF THE DISCLOSURE

Figure 1:
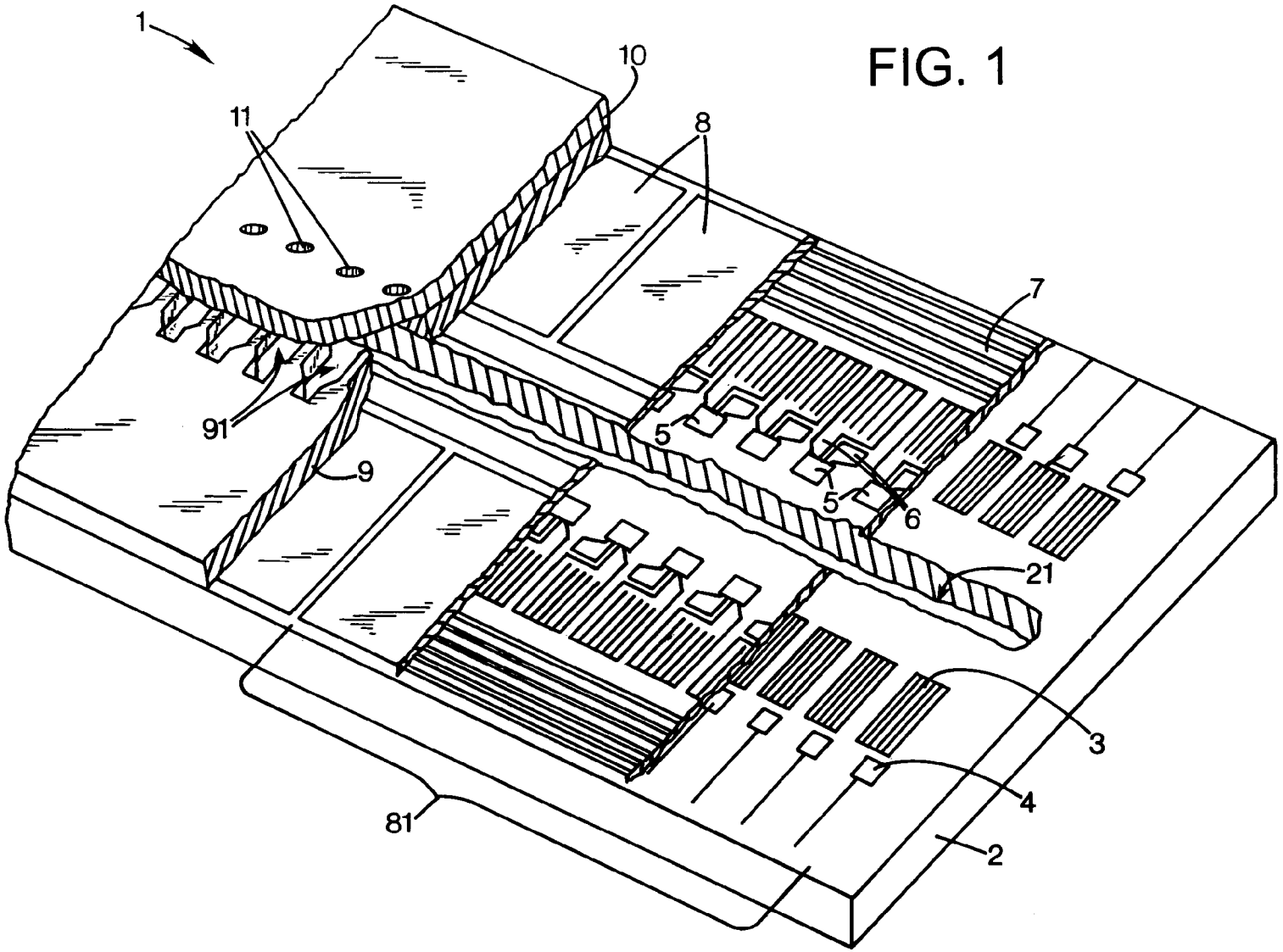
FIG. 1 is a cutaway view of an exemplary embodiment of a fluid ejection device.

In the following detailed description and in the several figures of the drawing, like elements are identified with like reference numerals.

FIG. 1 illustrates an exemplary embodiment of a fluid ejection device 1 in a simplified, partially broken-away, diagrammatic isometric view. The fluid ejection device may comprise a silicon substrate 2. Formed on the substrate, for example by thin film layers, are rows of drive transistors 3 with associated decode logic 4. The drive transistors 3 energize associated, respective resistors 5 or heating elements, however any structure that is capable of heating is capable of being utilized as a resistor. Electrical traces and vias 6 couple the drive transistors 3 to the resistors 5 and address busses 7. Disposed above the drive circuits are primitive power busses or power traces 8. Each primitive power buss 8 is electrically connected to a plurality of drive transistors and provides a common voltage, which acts as a power source, to all of the transistors to which it is connected. The group of transistors 3 and associated, respective resistors 5 powered by a given power buss 8, along with associated firing chambers 91 and nozzles 11, comprise a primitive group 81. In the exemplary embodiment of FIG. 1, two columns of firing resistors are separated by a fluid feed slot 21.

A barrier layer 9 defines a plurality of firing chambers 91, each associated with an individual firing resistor 5. An orifice layer or orifice plate 10 has nozzles 11 formed through the plate. Fluid fed from the feed slot 21 into a firing chamber 91 is heated by a resistor 5 when its associated transistor 3 fires, thereby heating the fluid and expelling some of the fluid out through an orifice 11. In the case of an ejection device which is an inkjet printhead, expelled ink may be propelled onto a media such as paper, mylar, fabric, or other media.

Figure 2A:
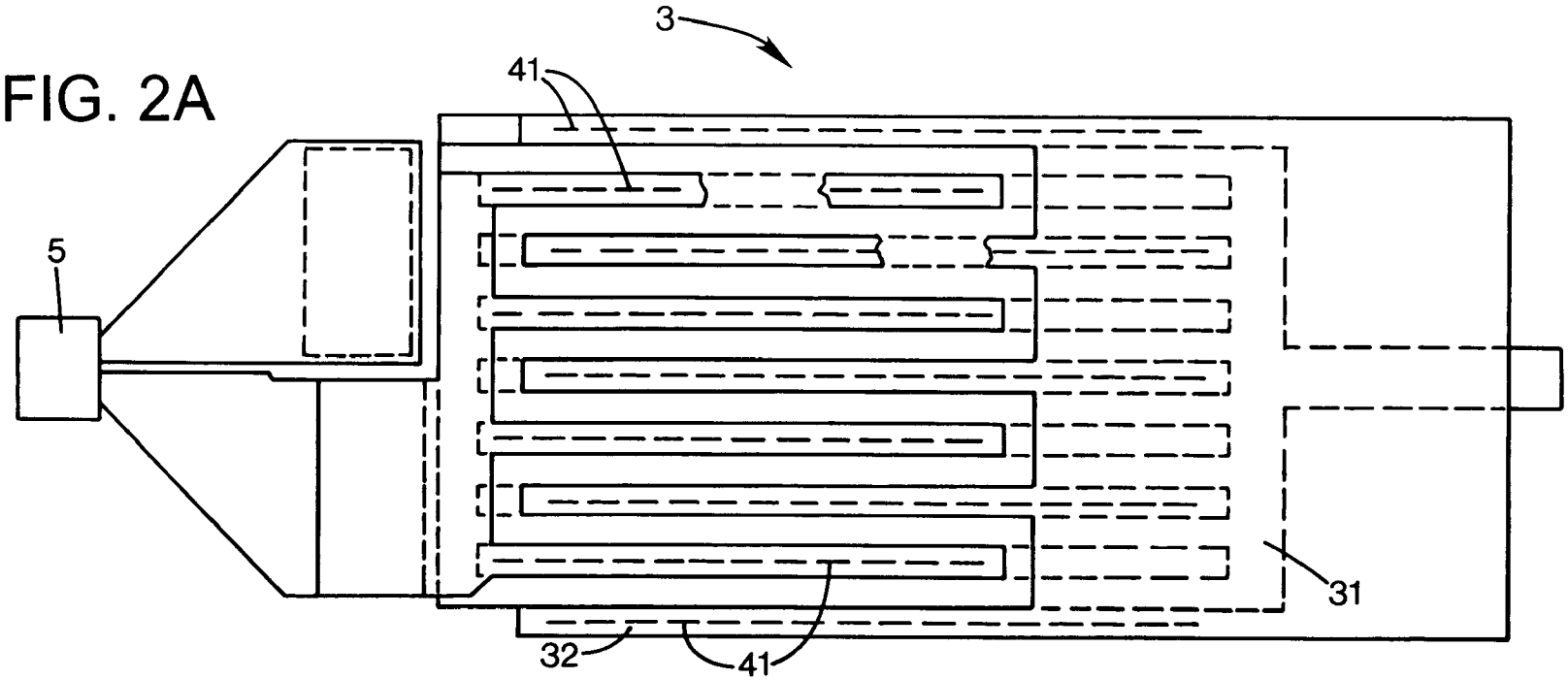
FIG. 2A illustrates a plan view of an exemplary embodiment of a layout of a drive transistor and firing resistor.
Figure 2B:
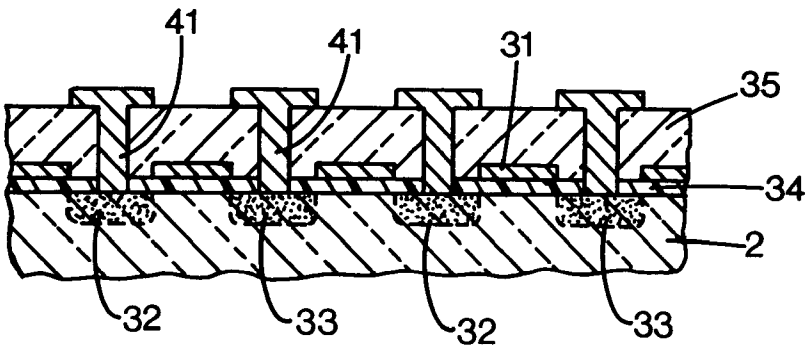
FIG. 2B illustrates a cross-sectional view of the exemplary embodiment of FIG. 2A.

FIGS. 2A and 2B illustrate an exemplary embodiment of a drive transistor 3 and resistor 5. A drive transistor 3 may comprise at least a polysilicon gate portion 31 disposed over a substrate 2. The polysilicon gate portion 31 may be disposed over a gate oxide layer 34 between the substrate and the polysilicon gate portion. Contacts 41 extend through an insulation layer 35 and may contact drain regions 32 or source regions 33, but not substrate 2. The insulation layer 35 may be disposed on the substrate and may be disposed over the polysilicon gate portions and may comprise phosphosilicate glass (PSG). The contacts may comprise PSG contacts, diffusion contacts, drain contacts, source contacts, poly contacts and/or other contacts.

Figure 3:
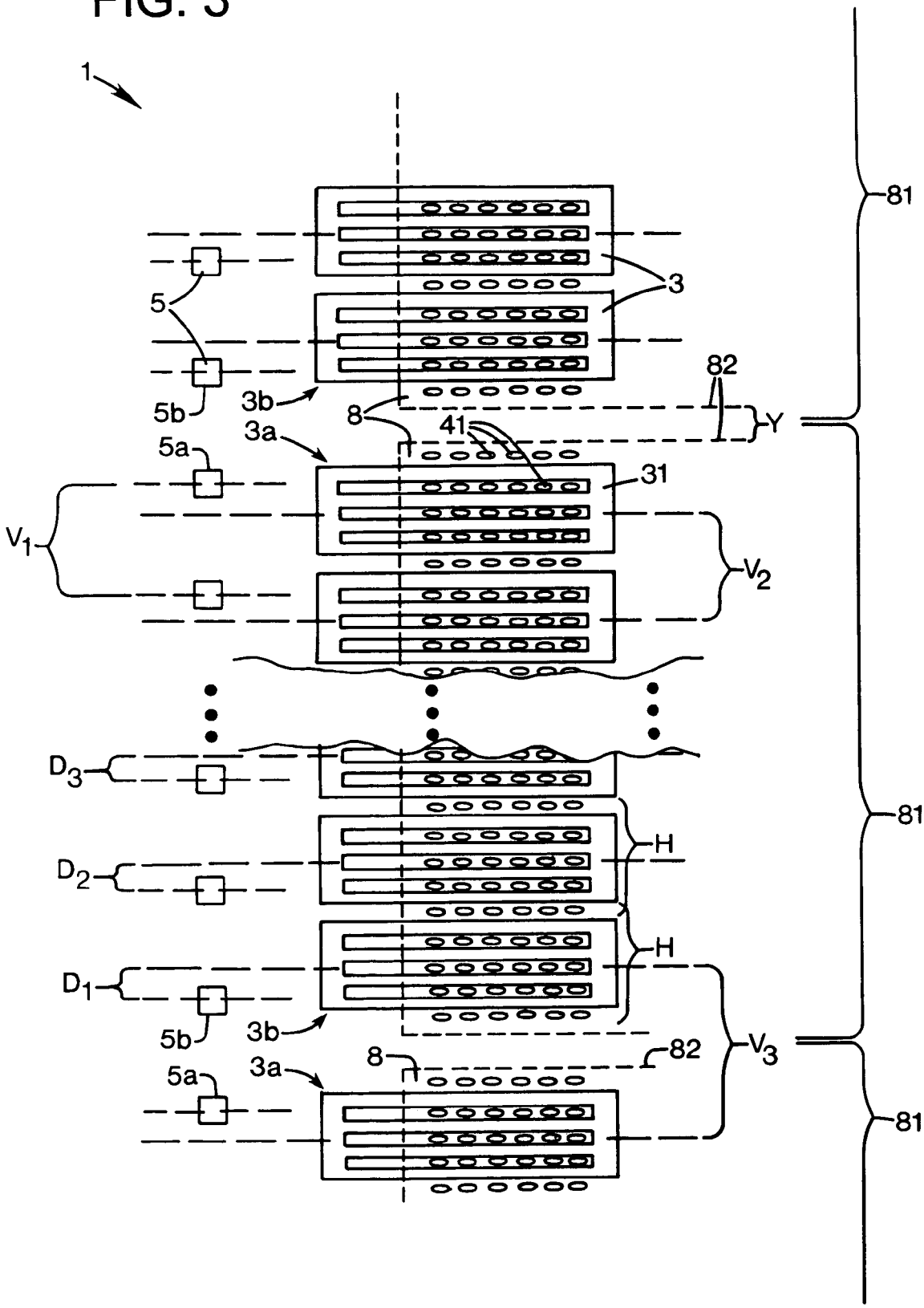
FIG. 3 illustrates an exemplary embodiment layout of transistors and power busses of a fluid ejection device.

FIG. 3 illustrates an exemplary embodiment of a layout of transistors and power busses in a fluid ejection device 1. The fluid ejection device has a plurality of firing resistors 5 and a plurality of associated drive transistors 3. For simplicity, the electrical traces and other features of a drive circuit are omitted from the illustration. For convenience, the columns may be considered as being arranged in a substantially vertical direction, but other orientations are possible and may be utilized with layouts and device structures described herein. For example, the resistors 5 and transistors 3 could be arranged in rows. The resistors 5 in the column may be evenly and uniformly spaced along the column. For instance, each resistor may be uniformly spaced, centerline-to-centerline, a vertical distance V1 from adjacent resistors along the column. In an exemplary embodiment, the resistors may be spaced, centerline-to-centerline, about 84.7 um apart. The resistors may have dimensions of about 28.6×14.2 um and may comprise split resistors with two halves separated by a gap of about 2 um. The centerline referred to in this exemplary embodiment is the horizontal line running through a point halfway between the uppermost extent of a resistor and the lowermost extent of that resistor. In this embodiment, the resistors are illustrated as of a rectilinear shape. In other embodiments, a different shape may be employed and/or a different centerline may be selected. Although the resistors 5 in FIG. 3 are shown in a column, in certain, alternative embodiments, the horizontal placement of some resistors along the column may be offset to one side or the other. In some embodiments, the resistors may not be uniformly spaced.

In this embodiment, the resistors 5 and transistors 3 of a column are arranged in primitive groups 81. The resistors 5 and associated, respective transistors 3 in a primitive group are each electrically connected to a common one of the plurality of power busses 8. In FIG. 3, the perimeter 82 of the areas covered by power busses 8 are designated with dotted lines. In an exemplary embodiment, a power buss 8 may be disposed as a conductive layer over the drive transistors 3, as shown in FIG. 1. The power busses 8 may comprise an electrically conductive layer which may comprise tantalum, gold, other metal, other conductive material, or alloys thereof. In an exemplary embodiment, the power buss 8 may have dimensions of about 21 77.5×198 um. A primitive group 81 may comprise 26 resistors 5 and 26 transistors 3.

The transistors may comprise a polysilicon gate portion 31 and contacts 41. In an exemplary embodiment, the contacts 41 lying between adjacent transistors 3 within a primitive group 81 may act as a contact 41 for the transistors on either side of the contacts 41. An exemplary transistor has a vertical height H. The height H may be defined between the outermost contacts which provide the electrical connection to the polysilicon, or the doped polysilicon or silicon substrate, as appropriate. The transistors 3 may be placed close together. Contacts 41 may be shared by adjacent transistors 3. In an exemplary embodiment, a transistor 3 may have dimensions of about 77.5×198 um.

The height of a transistor may be selected, in part, to provide desirable transistor efficiency. The overall efficiency of a transistor may be related, in part, to the surface area covered by the transistor. A transistor with a height H which is too small, may have an impedance which is too high for desired efficiency of operation. In FIG. 3, the transistors are shown, by way of example, with four polysilicon legs. The efficiency of the transistor may be increased, for example, by adding additional legs and corresponding additional drain and source regions and contacts as appropriate. In an exemplary embodiment, a transistor with desirable efficiency characteristics may have as many as eight polysilicon gate legs or more.

In an exemplary embodiment, transistors of a given primitive group may be uniformly spaced along the column of transistors. In FIG. 3, for example, the transistors 3 within a primitive group 81 are spaced, centerline-to-centerline, a distance V2 apart from adjacent transistors of the primitive group. In an exemplary embodiment, the transistors within a primitive group may be spaced, centerline-to-centerline, about 84 um apart. The spacing of the transistors 3 of a primitive group may be different from the spacing of the resistors of a primitive group. In FIG. 3, for example, the separation distance V2 of the transistor spacing is smaller than the separation distance V1 of the resistor spacing. The centerline referred to in this exemplary embodiment is the horizontal line running through a point halfway between the uppermost extent of the transistor and the lowermost extent of the transistor. In this embodiment, the transistors are illustrated as having a rectilinear shape. In other embodiments, a different transistor shape may be employed and/or a different centerline may be selected.

An upper-most transistor 3*a* of a primitive group 81 may be offset vertically downward from its associated, respective resistor 5*a*, and a lower-most transistor 3*b* of the primitive group 81 may be offset vertically upward from its associated, respective resistor 5*b*. The amount of vertical offset between each resistor in a primitive group and its respective transistor may be different for each pair or one or more pairs may be offset by different distances. In FIG. 3, for example, the vertical offset D1 is greater than the vertical offset D2 which, in turn, is greater than the vertical offset D3. In an exemplary embodiment, the vertical offsets D1, D2 and D3 may be about 6.5 um, 5.8 um and 5.1 um, respectively. The relative offset may decrease as one moves from the upper and/or lower resistor/transistor pairs toward the center of a primitive group 81. For a transistor near the vertical centerline of a power buss, there may be the smallest vertical offset of the primitive group 81 between a resistor and its associated transistor.

As a result, adjacent transistors of adjacent primitive groups, for example the upper-most transistor 3*a* of a primitive group 81 and the lower-most transistor 3*b* of an adjacent primitive group 81 may be spaced further from each other than spacing of the transistors within either one of the adjacent primitive groups 81. In FIG. 3, for example, an upper-most transistor 3*a* and a lower-most transistor 3*b* are spaced, centerline to centerline, a distance V3 apart, the distance V3 being greater than V1. In an exemplary embodiment, the upper-most transistor 3*a* and a lower-most transistor 3*b* may be spaced, centerline-to-centerline, about 100.4 um apart. In an alternative exemplary embodiment, the distance V3 could be less than V1.

In the exemplary embodiment of FIG. 3, each of the contacts 41 of the transistors 3 in each primitive group 81 are completely covered by and/or enclosed within the perimeter 82 of the area covered by the power buss 8. The power buss 8 may comprise a protective layer over the contacts 41. The power buss 8 may protect the substrate from chemical attack during an etch which may occur during manufacture of the fluid ejection device subsequent to laying down transistor 3, resistors 5 and the busses 8.

However, only a portion of each of the contacts 41 may be covered by power buss 8. The portion covered needs to be of sufficient to make a reliable electrical path between power buss 8 and contacts 41. The actual area of the covered portion is a function of contact surface area and transistor size.

An exemplary etch step may be a wet etch using an etchant, which may be TMAH. The etch step may define, in part, an ink feed slot 21 (FIG. 1). In an exemplary embodiment, an ink feed slot may be formed by a process comprising at least two steps. The two steps may be, for example, a wet etch followed by sand blasting. However, other methods and approaches including, but not limited to, laser drilling, drilling, or the like may be used. Without the protective layer, the etchant may attack the substrate through pinholes in a passivation layer over the PSG layer, in the region where the contacts pass through the insulation layer or PSG layer. The etchant may also attack the substrate directly through the contacts. The substrate may be "attacked" in areas of silicon that should not be etched, but which are unintentionally etched during the wet etch process. This may be due to passivation pinholes caused by uniformity and topology issues.

A power buss 8 may be arranged to cover each of the contacts of each of the transistors in the associated primitive group. The process of covering each of the contacts with a protective layer prior to an etch improved yield over a process in which each of the contacts were not covered by a protective layer.

The desired, minimum separation between the edges of adjacent power busses to achieve, in order to provide reliable electrical separation of the power busses, may depend on or be limited by the particular photo and etch tooling used in the manufacture of the fluid ejector. In an exemplary embodiment, the vertical distance Y (FIG. 3) between adjacent power busses 8 may be limited to about 8 um. Power buss separation is limited by the photo and etch tooling used in depositing the protective layer. In certain embodiments, an etchant used in the wet etch may remove material from along the edges of the power buss 8. As a result, the spacing between adjacent power busses 8 after the etch may be as much as about 2-4 additional microns larger than the gap prior to the etch. The minimum post-etch gap spacing may therefore be approximately 9.5-10 microns or more in the exemplary embodiment.

In an exemplary embodiment of a fluid ejection device 1, the vertical spacing or separation distance V1 of the resistors is dependent on the desired print quality as measured in dpi (dots per inch). In an exemplary embodiment, the distance V1 provides a resolution of up to 1200 dpi (1200×2400).

In FIG. 3, for example, if the upper most transistors 3*a* and adjacent lower most transistors 3*b* of adjacent primitive groups 81 were spaced the same distance apart as the resistors 5*a* and 5*b* and were not vertically offset from the resistors, some of the contacts would extend into the space Y between the power busses 8. If the space Y were already set as the minimum separation between adjacent power busses, it would not be possible to cover each of the contacts of the upper or lower most contacts with the protective layer of the power buss 8. If the transistors were simply made narrower, to increase the gap between transistors, efficiency of the transistors may be compromised or desirable efficiencies would not be achieved.

In the exemplary arrangement of transistors shown in FIG. 3, the transistors 3 within a primitive group 81 are spaced a distance V2 apart, V2 being smaller than the distance V3 between adjacent transistors of adjacent primitive groups 81. This enables a fluid ejection device 1 or printhead die of a given length to accommodate more transistors 3 of a given vertical height H while also providing power busses 8 which cover each of the contacts 41 of the transistors 3 of the associated primitive groups 81.

In other exemplary embodiments, the vertical spacing of the resistors 5 within a primitive group 81 may not be uniform. The vertical spacing of the transistors 3 of a primitive group 81 may not be spaced uniformly within the primitive group and/or the vertical spacing of the transistors 3 along a column of transistors may not match the spacing of the associated, corresponding resistors 5 along the associated column of resistors. Spacing lower most transistors 3*b* sufficiently far from upper most transistors 3*a* between adjacent primitive groups 81 will allow adjacent power busses 8 to be sufficiently separated to provide electrical isolation of the adjacent power busses 8 while providing a protective covering over the contacts 41 of all of the transistors 3 of each primitive group 81. Within the primitive group 81, the transistors may be spaced as close or as far apart as desired. The transistors 3 of a primitive group 81 may be spaced more closely than the associated, respective resistors 5 of the primitive group 81. The spacing of transistors 3 within a primitive group 81 may be closer than the spacing between the lower most transistor of one primitive group and the upper-most transistor of an adjacent primitive group 81. This arrangement or layout of transistors 3 may provide more efficient use of space on the silicon die. The spacing of transistors 3 within one primitive group 81 may be different from the spacing of transistors 3 within another primitive group 81.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A fluid ejection device comprising:

a first heater element;

a second heater element vertically spaced a first distance from the first heater element;

a first drive transistor associated with the first heater element;

a second drive transistor associated with the second heater element, the second drive transistor vertically spaced a second distance from the first drive transistor, the second distance being different than the first distance; and a power bus electrically connected to contacts of the first drive transistor, and being a protective layer covering the contacts of the first drive transistor.

2. The fluid ejection device of claim 1, wherein the first distance is greater than the second distance.

3. The fluid ejection device of claim 2, further comprising a primitive group of drive transistors, wherein the primitive group of drive transistors comprises the first and second transistors.

4. The fluid ejection device of claim 1, wherein the first distance is less than the second distance.

5. The fluid ejection device of claim 4, further comprising a first primitive group of drive transistors and an adjacent second primitive group of drive transistors, wherein the first primitive group comprises the first drive transistor and the second primitive group comprises the second drive transistor.

6. The fluid ejection device of claim 1, wherein the first distance is a heater element centerline-to-centerline spacing, and the second distance is a transistor center-to-centerline spacing.

7. A fluid ejection device comprising:

a first primitive group comprising a plurality of drive transistors and a corresponding plurality of associated firing heater elements; and a second primitive group comprising a plurality of drive transistors and a corresponding plurality of associated firing heater elements; and wherein a first spacing between the plurality of drive transistors in the first primitive group is different from a second spacing between the plurality of drive transistors in the second primitive group.

8. The fluid ejection device of claim 7, wherein the plurality of drive transistors are spaced more closely with respect to each other than the plurality of associated firing heater elements are spaced with respect to each other.

9. The fluid ejection device of claim 8, wherein the plurality of drive transistors from the first and second primitive groups comprise contacts, the fluid ejection device further comprising:

a layer of metal disposed over each of the contacts of the first and second primitive groups.

10. The fluid ejection device of claim 9, whcrein the layer of metal comprises a power bus connected to each of the plurality of drive transistors.

11. The fluid ejection device of claim 9, wherein the layer of metal is disposed over an entire surface of each of the contacts of the first and second primitive groups.

12. The fluid ejection device of claim 7, wherein the plurality of drive transistors from the first and second primitive groups are arranged in a column of drive transistors and the plurality of associated firing heater elements are arranged in a column of firing heater elements alongside the column of drive transistors.

13. The fluid ejection device of claim 12, wherein in the first primitive group, the plurality of drive transistors are spaced more closely with respect to each other than the plurality of associated firing heater elements are spaced with respect to each other.

14. The fluid ejection device of claim 13, wherein the plurality of drive transistors comprise contacts and further comprising:

a layer of metal disposed over each of the contacts of the first primitive group.

15. The fluid ejection device of claim 14, wherein the layer of metal comprises a power bus connected to each of the plurality of drive transistors of the first primitive group.

16. The fluid ejection device of claim 14, wherein the layer of metal is disposed over an entire surface of each of the contacts of the first primitive group.

17. The fluid ejection device of claim 7, wherein the second primitive group being adjacent the first primitive group, wherein the plurality of drive transistors of the second primitive group are spaced more closely with respect to each other than the plurality of firing heater elements of the second primitive group are spaced with respect to each other.

18. The fluid ejection device of claim 7, wherein the first primitive group comprises an adjacent pair of drive transistors spaced a first distance apart from each other; and the first primitive group is separated from the second primitive group a second distance, the second distance being greater than the first distance.

19. A fluid ejection device comprising:

a vertical column of firing heater elements and a vertical column of associated drive transistors; wherein a first firing heater element of the vertical column of firing heater elements is vertically separated centerline-to-centerline by a first distance from an associated first drive transistor; and an adjacent second firing heater element of the vertical column of firing heater elements is vertically separated centerline-to-centerline by a second distance from an associated second dnve transistor, wherein the first distance and second distance are different.

20. The fluid ejection device of claim 19 further comprising:

a primitive group comprising a plurality of firing heater elements of the vertical column of firing heater elements and a plurality of associated drive transistors of the vertical column of drive transistors;

wherein the primitive group comprises the first and second firing heater elements and the associated first and second drive transistors.

21. The fluid ejection device of claim 20, wherein the drive transistors of the primitive group are spaced more closely center line-to-centerline along the vertical column of drive transistors than the firing heater elements of the primitive group are spaced from centerline-to-centerline along the vertical column of firing heater elements.

22. The fluid ejection device of claim 20, wherein the plurality of firing heater elements of the primitive group are unifoimly spaced from each other by a distance V1 and the plurality of drive transistors arc uniformly spaced from each other by a distance V2, the distance V2 being less than V1.

23. The fluid ejection device of claim 22, wherein the distance V1 provides a fluid ejection device resolution of 1200 dots per inch.

24. The fluid ejection device of claim 19 further comprising:

a primitive group comprising the vertical column of firing heater elements and the vertical column of drive transistors;

a power buss associated with the primitive group and electrically connected to provide a common power source for all of the plurality of drive transistors;

wherein the primitive group comprises the first and second firing heater elements and the associated first and second drive transistors.

25. The fluid ejection device of claim 24, wherein the drive transistors of the primitive group are spaced more closely center line-to-centerline along the vertical column of drive transistors than the firing heater elements of the primitive group are spaced centerline-to-centerline along the vertical column of firing heater elements.

26. The fluid ejection device of claim 24, wherein the plurality of firing heater elements of the primitive group are uniformly spaced a distance V1 and the plurality of drive transistors are uniformly spaced a distance V2, the distance V2 being less tan V1.

27. The fluid ejection device of claim 24, wherein the power buss has a perimeter defining an area, the plurality of drive transistors each have contacts and the contacts of the plurality of drive transistors are all enclosed within the perimeter.

28. The fluid ejection device of claim 27, wherein the drive transistors of the primitive group are spaced more closely centerline-to-centerline along the vertical column of drive transistors than the firing heater elements of the primitive group are spaced centerline-to-centerline along the vertical column of firing heater elements.

29. The fluid ejection device of claim 27, wherein the plurality of firing heater elements of the primitive group are uniformly spaced a distancc V1 and the plurality of drive transistors are uniformly spaced a distance V2, the distance V2 being less than V1.

30. The fluid ejection device of claim 19 comprising:

a first primitive group comprising a first plurality of firing resistors of the column of firing resistors and a first plurality of associated drive transistors of the column of drive transistors;

an adjacent second primitive group comprising a second plurality of firing heater elements of the column of flung heater elements and a second plurality of drive transistors of the column of drive transistors;

first and second electrical power busses, each power buss associated with the drive transistors of the first or second primitive group respectively and electrically connected to the first or second plurality of drive transistors of the respective first or second primitive group respectively and electrically isolated from the other power buss.

31. The fluid ejection device of claim 30, wherein the first plurality of drive transistors of the first primitive group are spaced more closely from each other center line-to-centerline along the vertical column of drive transistors than the first plurality of firing heater elements of the first primitive group are spaced centerline-to-centerline along the vertical column of firing heater elements; and the second plurality of drive transistors of the second primitive group are spaced more closely from each other center line-to-centerline along the vertical column of drive transistors than the second plurality of firing heater elements of the second primitive group are spaced centerline-to-centerline along the vertical column of firing heater elements.

32. The fluid ejection device of claim 30, wherein the first plurality of firing heater elements of the first primitive group are uniformly spaced a distance V1 and the first plurality of drive transistors of the first primitive group are uniformly spaced a distance V2, the distance V2 being less than V1.

33. The fluid ejection device of claim 30, wherein:

a lowermost drive transistor of the first primitive group is vertically spaced centerline-to-centerline a distance V3 from an uppermost drive transistor of the adjacent second primitive group; and the drive transistors of one of the first or second primitive groups are vertically spaced more closely than the distance V3.

34. The fluid ejection device of claim 33, wherein the first plurality of drive transistors of the first primitive group are spaced more closely center line-to-centerline along the vertical column of drive transistors than the first plurality of firing heater elements of the first primitive group are spaced centerline-to-centerline along the vertical column of firing heater elements; and the second plurality of drive transistors of the second primitive group are spaced more closely center line-to-centerline along the vertical column of drive transistors than the second plurality of firing heater elements of the second primitive group are spaced centerline-to-centerline along the vertical column of firing heater elements.

35. The fluid ejection device of claim 33, wherein the first plurality of firing heater elements of the first primitive group are unifonnly spaced a distance V1 apart from each other and the first plurality of drive transistors of the first primitive group are unifonuly spaced a distance V2 apart from each other, the distance V2 being less than V1 and the distance V1 being less than the distance V3.

* * * * *

UNITED STATES PATENT AND TRADEMARK OFFICE

CERTIFICATE OF CORRECTION

PATENT NO. : 7,278,706 B2
APPLICATION NO. : 10/696847
DATED : October 9, 2007
INVENTOR(S) : Simon Dodd et al.

It is certified that error appears in the above-identified patent and that said Letters Patent is hereby corrected as shown below:

In column 6, line 48, in Claim 10, delete “whcrein” and insert -- wherein --, therefor.

In column 7, line 33, in Claim 19, delete “dnve” and insert -- drive --, therefor.

In column 7, line 54, in Claim 22, delete “unifoimly” and insert -- uniformly --, therefor.

In column 7, line 55, in Claim 22, delete “arc” and insert -- are --, therefor.

In column 8, line 13, in Claim 26, delete “spaccd” and insert -- spaced --, therefor.

In column 8, line 14, in Claim 26, delete “tan” and insert -- than --, therefor.

In column 8, line 29, in Claim 29, delete “distancc” and insert -- distance --, therefor.

In column 8, line 39, in Claim 30, delete “flung” and insert -- firing --, therefor.

In column 10, line 10, in Claim 35, delete “unifonnly” and insert -- uniformly --, therefor.

In column 10, line 12, in Claim 35, delete “unifonuly” and insert -- uniformly --, therefor.

Signed and Sealed this

Seventh Day of July, 2009

John Doll

JOHN DOLL
*Acting Director of the United States Patent and Trademark Office*